US006615169B1

(12) United States Patent
Ojala et al.

(10) Patent No.: US 6,615,169 B1
(45) Date of Patent: Sep. 2, 2003

(54) HIGH FREQUENCY ENHANCEMENT LAYER CODING IN WIDEBAND SPEECH CODEC

(75) Inventors: Pasi Ojala, Lempäälä (FI); Jani Rotola-Pukkila, Tampere (FI); Janne Vainio, Lempäälä (FI); Hannu Mikkola, Tampere (FI)

(73) Assignee: Nokia Corporation, Espoo (FI)

( * ) Notice: Subject to any disclaimer, the term of this patent is extended or adjusted under 35 U.S.C. 154(b) by 403 days.

(21) Appl. No.: 09/691,440

(22) Filed: Oct. 18, 2000

(51) Int. Cl.[7] ..... G10L 19/02

(52) U.S. Cl. ..... 704/205; 704/206; 704/210; 704/225

(58) Field of Search ..... 704/200, 200.1, 704/205–210, 219–230

(56) References Cited

U.S. PATENT DOCUMENTS

| | | | | | |
|---|---|---|---|---|---|
| 4,610,022 | A | * | 9/1986 | Kitayama et al. | 704/205 |
| 5,581,652 | A | * | 12/1996 | Abe et al. | 704/222 |
| 5,978,759 | A | * | 11/1999 | Tsushima et al. | 704/223 |
| 6,014,621 | A | * | 1/2000 | Chen | 704/220 |

FOREIGN PATENT DOCUMENTS

| | | | |
|---|---|---|---|
| EP | 1008984 | 6/2000 | G10L/21/02 |

OTHER PUBLICATIONS

Draft ETSI EN 300 726 V7.0.1 Digital cellular telecommunications system (Phase 2+); Enhanced Full Rate (EFR) speech transcoding; (GSM 06.60 version 7.0.1 Release 1998), Jul. 1999, pp 1–47.

3G TS 26.071 V3.0.1 3rd Generation Partnership Project; Technical Specification Group Services and System Aspects; Mandatory Speech Codec speech processing functions AMR Speech Codec; General Description, Aug. 1999, pp 1–13.

3G TS 26.094 V3.0.0 3rd Generation Partnership Project; Technical Specification Group Services and System Aspects; Manadatory Speech Codec speech processing functions AMR speech codec; Voice Activity Detector (VAD), Oct. 1999, pp 1–29.

"A 13.0 kbit/s wideband speech codec based on SB–ACELP"; J. Schnitzler; Acoustics, Speech and Signal Processing, 1998; Proceedings of the 1998 IEEE International Conference on Seattle, WA, (May 12, 1995); pp. 157–160.

"Bandwidth extension of narrowband speech for low bit–rate wideband coding"; J. M. Valin et al.; 2000 IEEE Workshop on Speech Coding. Proceedings. Meeting the Challenges of the New Millenium, Delavan, WI; Sep. 17–20, 2000; pp. 130–132.

* cited by examiner

*Primary Examiner*—David D. Knepper
(74) *Attorney, Agent, or Firm*—Ware, Fressola, Van Der Sluys & Adolphson, LLP

(57) ABSTRACT

A speech coding method and device for encoding and decoding an input signal and providing synthesized speech, wherein the higher frequency components of the synthesized speech are achieved by high-pass filtering and coloring an artificial signal to provide a processed artificial signal. The processed artificial signal is scaled by a first scaling factor during the active speech periods of the input signal and a second scaling factor during the non-active speech periods, wherein the first scaling factor is characteristic of the higher frequency band of the input signal and the second scaling factor is characteristic of the lower frequency band of the input signal. In particular, the second scaling factor is estimated based on the lower frequency components of the synthesized speech and the coloring of the artificial signal is based on the linear predictive coding coefficients characteristic of the lower frequency of the input signal.

25 Claims, 7 Drawing Sheets

HIGH FREQUENCY ENHANCEMENT LAYER CODING IN WIDEBAND SPEECH CODEC

FIELD OF THE INVENTION

The present invention generally relates to the field of coding and decoding synthesized speech and, more particularly, to an adaptive multi-rate wideband speech codec.

BACKGROUND OF THE INVENTION

Many methods of coding speech today are based upon linear predictive (LP) coding, which extracts perceptually significant features of a speech signal directly from a time waveform rather than from a frequency spectra of the speech signal (as does what is called a channel vocoder or what is called a formant vocoder). In LP coding, a speech waveform is first analyzed (LP analysis) to determine a time-varying model of the vocal tract excitation that caused the speech signal, and also a transfer function. A decoder (in a receiving terminal in case the coded speech signal is telecommunicated) then recreates the original speech using a synthesizer (for performing LP synthesis) that passes the excitation through a parameterized system that models the vocal tract. The parameters of the vocal tract model and the excitation of the model are both periodically updated to adapt to corresponding changes that occurred in the speaker as the speaker produced the speech signal. Between updates, i.e. during any specification interval, however, the excitation and parameters of the system are held constant, and so the process executed by the model is a linear time-invariant process. The overall coding and-decoding (distributed) system is called a codec.

In a codec using LP coding to generate speech, the decoder needs the coder to provide three inputs: a pitch period if the excitation is voiced, a gain factor and predictor coefficients. (In some codecs, the nature of the excitation, i.e. whether it is voiced or unvoiced, is also provided, but is not normally needed in case of an Algebraic Code Excited Linear Predictive (ACELP) codec, for example. LP coding is predictive in that it uses prediction parameters based on the actual input segments of the speech waveform (during a specification interval) to which the parameters are applied, in a process of forward estimation.

Basic LP coding and decoding can be used to digitally communicate speech with a relatively low data rate, but it produces synthetic sounding speech because of its using a very simple system of excitation. A so-called Code Excited Linear Predictive (CELP) codec is an enhanced excitation codec. It is based on "residual" encoding. The modeling of the vocal tract is in terms of digital filters whose parameters are encoded in the compressed speech. These filters are driven, i.e. "excited," by a signal that represents the vibration of the original speaker's vocal cords. A residual of an audio speech signal is the (original) audio speech signal less the digitally filtered audio speech signal. A CELP codec encodes the residual and uses it as a basis for excitation, in what is known as "residual pulse excitation." However, instead of encoding the residual waveforms on a sample-by-sample basis, CELP uses a waveform template selected from a predetermined set of waveform templates in order to represent a block of residual samples. A codeword is determined by the coder and provided to the decoder, which then uses the codeword to select a residual sequence to represent the original residual samples.

According to the Nyquist theorem, a speech signal with a sampling rate $F_s$ can represent a frequency band from 0 to 0.5 $F_s$. Nowadays, most speech codecs (coders-decoders) use a sampling rate of 8 kHz. If the sampling rate is increased from 8 kHz, naturalness of speech improves because higher frequencies can be represented. Today, the sampling rate of the speech signal is usually 8 kHz, but mobile telephone stations are being developed that will use a sampling rate of 16 kHz. According to the Nyquist theorem, a sampling rate of 16 kHz can represent speech in the frequency band 0–8 kHz. The sampled speech is then coded for communication by a transmitter, and then decoded by a receiver. Speech coding of speech sampled using a sampling rate of 16 kHz is called wideband speech coding.

When the sampling rate of speech is increased, coding complexity also increases. With some algorithms, as the sampling rate increases, coding complexity can even increase exponentially. Therefore, coding complexity is often a limiting factor in determining an algorithm for wideband speech coding. This is especially true, for example, with mobile telephone stations where power consumption, available processing power, and memory requirements critically affect the applicability of algorithms.

In the prior-art wideband codec, as shown in FIG. 1, a pre-processing stage is used to low-pass filter and down-sample the input speech signal from the original sampling frequency of 16 kHz to 12.8 kHz. The down-sampled signal is then decimated so that the number of samples of 320 within a 20 ms period are reduced to 256. The down-sampled and decimated signal, with an effective frequency bandwidth of 0 to 6.4 kHz, is encoded using an Analysis-by-Synthesis (A-b-S) loop to extract LPC, pitch and excitation parameters, which are quantized into an encoded bit stream to be transmitted to the receiving end for decoding. In the A-b-S loop, a locally synthesized signal is further up sampled and interpolated to meet the original sample frequency. After the encoding process, the frequency band of 6.4 kHz to 8.0 kHz is empty. The wideband codec generates random noise on this empty frequency range and colors the random noise with LPC parameters by synthesis filtering as described below.

The random noise is first scaled according to $$e_{scaled}=sqrt[\{exc^T(n)exc(n)\}/\{e^T(n)e(n)\}]e(n) \quad (1)$$

where e(n) represents the random noise and exc(n) denotes the LPC excitation. The superscript T denotes the transpose of a vector. The scaled random noise is filtered using the coloring LPC synthesis filter and a 6.0–7.0 kHz band pass filter. This colored, high-frequency component is further scaled using the information about the spectral tilt of the synthesized signal. The spectral tilt is estimated by calculating the first autocorrelation coefficient, r, using the following equation:

$$r=\{s^T(i)s(i-1)\}/\{s^T(i)s(i)\} \quad (2)$$

where s(i) is the synthesized speech signal. Accordingly, the estimated gain $f_{est}$ is determined from $$f_{est}=1.0-r \quad (3)$$

with the limitation $0.2 \leqq f_{est} \leqq 1.0$.

At the receiving end, after the core decoding process, the synthesized signal is further post-processed to generate the actual output by up-sampling the signal to meet the input signal sampling frequency. Because the high frequency noise level is estimated based on the LPC parameters obtained from the lower frequency band and the spectral tilt of the synthesized signal, the scaling and coloring of the random noise can be carried out in the encoder end or the decoder end.

In the prior-art codec, the high frequency noise level is estimated based on the base layer signal level and spectral tilt. As such, the high frequency components in the synthesized signal are filtered away. Hence, the noise level does not correspond to the actual input signal characteristics in the 6.4–8.0 kHz frequency range. Thus, the prior-art codec does not provide a high quality synthesized signal.

It is advantageous and desirable to provide a method and a system capable of providing a high quality synthesized signal taking into consideration the actual input signal characteristics in the high frequency range.

SUMMARY OF THE INVENTION

It is a primary objective of the present invention to improve the quality of synthesized speech in a distributed speech processing system. This objective can be achieved by using the input signal characteristics of the high frequency components in the original speech signal in the 6.0 to 7.0 kHz frequency range, for example, to determine the scaling factor of a colored, high-pass filtered artificial signal in synthesizing the higher frequency components of the synthesized speech during active speech periods. During non-active speech periods, the scaling factor can be determined by the lower frequency components of the synthesized speech signal.

Accordingly, the first aspect of the present invention is a method of speech coding for encoding and decoding an input signal having active speech periods and non-active speech periods, and for providing a synthesized speech signal having higher frequency components and lower frequency components, wherein the input signal is divided into a higher frequency band and lower frequency band in encoding and speech synthesizing processes and wherein speech related parameters characteristic of the lower frequency band are used to process an artificial signal for providing the higher frequency components of the synthesized speech signal. The method comprises the steps of:

- scaling the processed artificial signal with a first scaling factor during the active speech periods, and
- scaling the processed artificial signal with a second scaling factor during the non-active speech periods, wherein the first scaling factor is characteristic of the higher frequency band of the input signal, and the second scaling factor is characteristic of the lower frequency components of the synthesized speech.

Preferably, the input signal is high-pass filtered for providing a filtered signal in a frequency range characteristic of the higher frequency components of the synthesized speech, wherein the first scaling factor is estimated from the filtered signal, and wherein when the non-active speech periods include speech hangover periods and comfort noise periods, the second scaling factor for scaling the processed artificial signal in the speech hangover periods is estimated from the filtered signal.

Preferably, the second scaling factor for scaling the processed artificial signal during the speech hangover periods is also estimated from the lower frequency components of the synthesized speech, and the second scaling factor for scaling the processed artificial signal during the comfort noise periods is estimated from the lower frequency components of the, synthesized speech signal.

Preferably, the first scaling factor is encoded and transmitted within the encoded bit stream to a receiving end and the second scaling factor for the speech hangover periods is also included in the encoded bit stream.

It is possible that the second scaling factor for speech hangover periods is determined in the receiving end.

Preferably, the second scaling factor is also estimated from a spectral tilt factor determined from the lower frequency components of the synthesized speech.

Preferably, the first scaling factor is further estimated from the processed artificial signal.

The second aspect of the present invention is a speech signal transmitter and receiver system for encoding and decoding an input signal having active speech periods and non-active speech periods and for providing a synthesized speech signal having higher frequency components and lower frequency components, wherein the input signal is divided into a higher frequency band and a lower frequency band in the encoding and speech synthesizing processes, wherein speech related parameters characteristic of the lower frequency band of the input signal are used to process an artificial signal in the receiver for providing the higher frequency components of the synthesized speech. The system comprises:

- a decoder in the receiver for receiving an encoded bit stream from the transmitter, wherein the encoded bit stream contains the speech related parameters;
- a first module in the transmitter, responsive to the input signal, for providing a first scaling factor for scaling the processed artificial signal during the active periods, and
- a second module in the receiver, responsive to the encoded bit stream, for providing a second scaling factor for scaling the processed artificial signal during the non-active periods, wherein the first scaling factor is characteristic of the higher frequency band of the input signal and the second scaling factor is characteristic of the lower frequency components of the synthesized speech.

Preferably, the first module includes a filter for high pass filtering the input signal and providing a filtered input signal having a frequency range corresponding to the higher frequency components of the synthesized speech so as to allow the first scaling factor to be estimated from the filtered input signal.

Preferably, a third module in the transmitter is used for providing a colored, high-pass filtered random noise in the frequency range corresponding to the higher frequency components of the synthesized signal so that the first scaling factor can be modified based on the colored, high-pass filtered random noise.

The third aspect of the present invention is an encoder for encoding an input signal having active speech periods and non-active speech periods, and the input signal is divided into a higher frequency band and a lower frequency band, and for providing an encoded bit stream containing speech related parameters characteristic of the lower frequency band of the input signal so as to allow a decoder to reconstruct the lower frequency components of synthesized speech based on the speech related parameters and to process an artificial signal based on the speech related parameters for providing high frequency components of the synthesized speech, and wherein a scaling factor based on the lower frequency components of the synthesized speech is used to scale the processed artificial signal during the non-active speech periods. The encoder comprises:

- a filter, responsive to the input signal, for high-pass filtering the input signal in a frequency range corresponding to the higher frequency components of the synthesized speech, and providing a first signal indicative of the high-pass filtered input signal;

means, responsive to the first signal, for providing a further scaling factor based on the high-pass filtered input signal and the lower frequency components of the synthesized speech and for providing a second signal indicative of the further scaling factor; and a quantization module, responsive to the second signal, for providing an encoded signal indicative of the further scaling factor in the encoded bit stream, so as to allow the decoder to scale the processed artificial signal during the active-speech periods based on the further scaling factor.

The fourth aspect of the present invention is a mobile station, which is arranged to transmit an encoded bit stream to a decoder for providing synthesized speech having higher frequency components and lower frequency components, wherein the encoded bit stream includes speech data indicative of an input signal having active speech periods and non-active periods, and the input signal is divided into a higher frequency band and lower frequency band, wherein the speech data includes speech related parameters characteristic of the lower frequency band of the input signal so as to allow the decoder to provide the lower frequency components of the synthesized speech based on the speech related parameters, and to color an artificial signal based on the speech related parameters and scale the colored artificial signal with a scaling factor based on the lower frequency components of the synthesized speech for providing the high frequency components of the synthesized speech during the non-active speech periods. The mobile station comprises:

a filter, responsive to the input signal, for high-pass filtering the input signal in a frequency range corresponding to the higher frequency components of the synthesized speech, and for providing a further scaling factor based on the high-pass filtered input signal; and a quantization module, responsive to the scaling factor and the further scaling factor, for providing an encoded signal indicative of the further scaling factor in the encoded bit stream, so as to allow the decoder to scale the colored artificial signal during the active-speech period based on the further scaling factor.

The fifth aspect of the present invention is an element of a telecommunication network, which is arranged to receive an encoded bit stream containing speech data indicative of an input signal from a mobile station for providing synthesized speech having higher frequency components and lower frequency components, wherein the input signal, having active speech periods and non-active periods, and the input signal are divided into a higher frequency band and lower frequency band, wherein the speech data includes speech related parameters characteristic of the lower frequency band of the input signal. The element comprises:

a first mechanism, responsive to the speech data, for providing the lower frequency components of the synthesized speech based on the speech related parameters, and for providing a first signal indicative of the lower frequency components of the synthesized speech;

a second mechanism, responsive to the speech data, for synthesis and high-pass filtering an artificial signal for providing a second signal indicative of the synthesis and high-pass filtered artificial signal;

a third mechanism, responsive to the first signal, for providing a first scaling factor based on the lower frequency components of the synthesized speech;

a fourth mechanism, responsive to the encoded bit stream, for providing a second scaling factor based on gain parameters characteristic of the higher frequency band of the input signal, wherein the gain parameters are included in the encoded bit stream; and a fifth mechanism, responsive to the second signal, for scaling the synthesis and high-pass filtered artificial signal with the first and second scaling factors during non-active speech periods and active speech periods, respectively.

The present invention will become apparent upon reading the description taken in conjunction with FIGS. 2 to 7.

DETAILED DESCRIPTION

Figure 1:
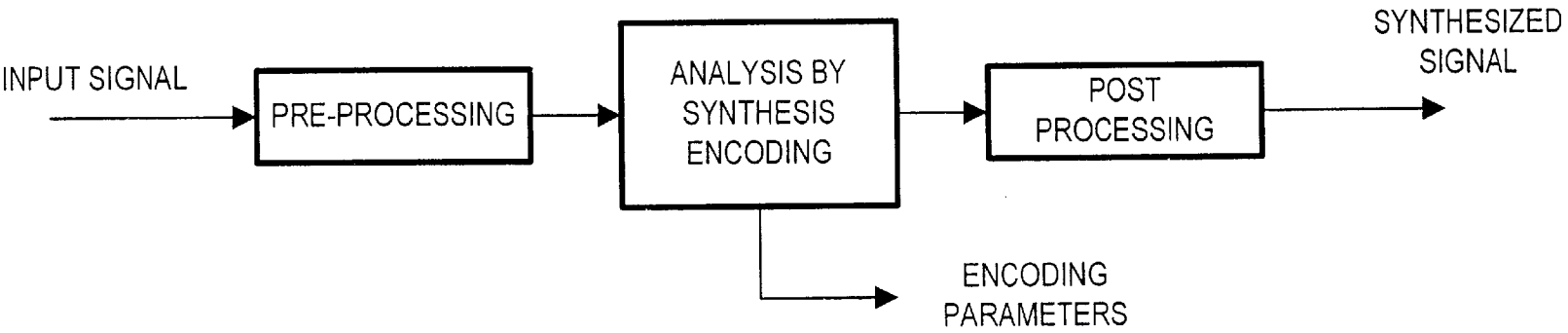
FIG. 1 (Prior Art)
FIG. 1 is a block diagram illustrating a prior-art wideband speech codec.
Figure 2:
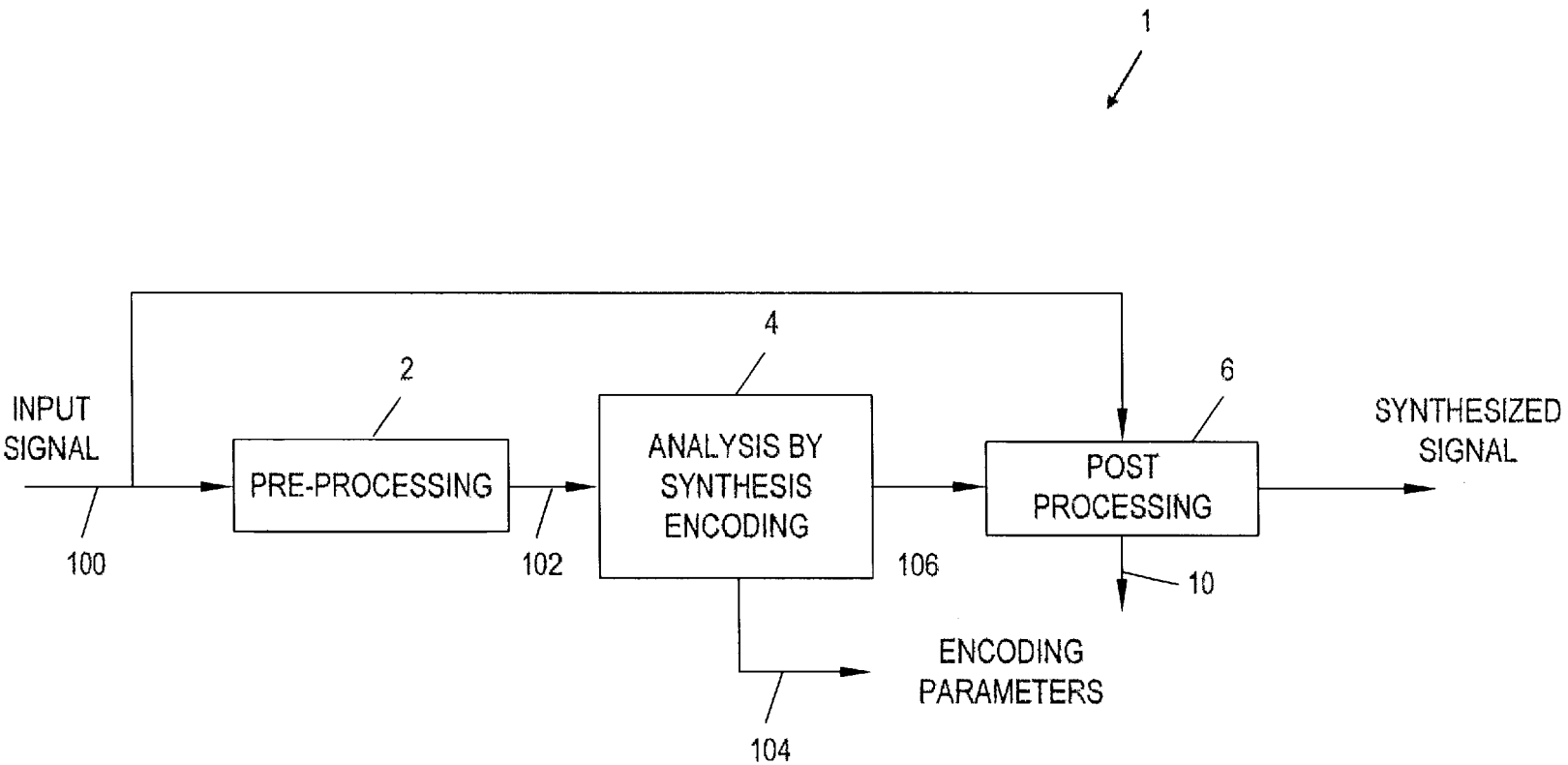
FIG. 2 is a block diagram illustrating the wideband speech codec, according to the present invention.

As shown in FIG. 2, the wideband speech codec 1, according to the present invention, includes a pre-processing block 2 for pre-processing the input signal 100. Similar to the prior-art codec, as described in the background section, the pre-processing block 2 down-samples and decimates the input signal 100 to become a speech signal 102 with an effective bandwidth of 0–6.4 kHz. The speech signal 102 is encoded by the Analysis-by-Synthesis encoding block 4 using the conventional ACELP technology in order to extract a set of Linear Predictive Coding (LPC) pitch and excitation parameters or coefficients 104.

The same coding parameters can be used, along with a high-pass filtering module to process an artificial signal, or pseudo-random noise, into a colored, high-pass filtered random noise 106.

In contrast to the prior-art wideband codec, the post-processing function of the post-processing block 6 is modified to incorporate the gain scaling and gain quantization corresponding to input signal characteristics of the high frequency components of the original speech signal 100. More particularly, the high-frequency components of the original speech signal 100 can be used, along with the colored, high-pass filtered random noise 106, to determine a high-band signal scaling factor, as shown in Equation 4, described in conjunction with the speech encoder, as shown in FIG. 3.

Figure 3:
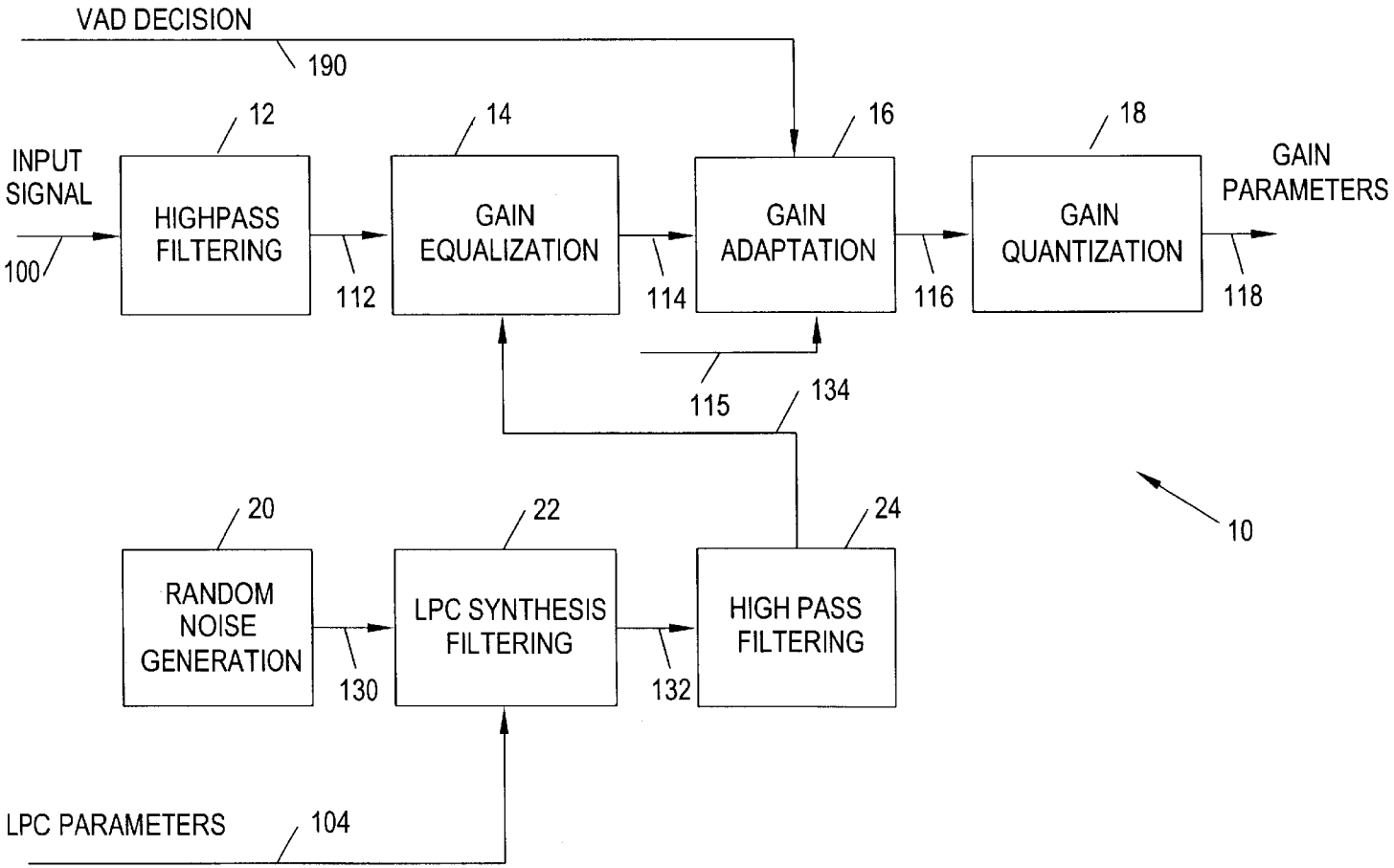
FIG. 3 is a block diagram illustrating the post-processing functionality of the wideband speech encoder of the present invention.

FIG. 3 illustrates the detailed structure of the post-processing functionality in the speech encoder 10, according to the present invention. As shown, a random noise generator 20 is used to provide a 16 kHz artificial signal 130. The random noise 130 is colored by an LPC synthesis filter 22 using the LPC parameters 104 provided in the encoded bit stream from the Analysis-by-Synthesis encoding block 4 (FIG. 2) based on the characteristics of the lower band of the speech signal 100. From the colored random noise 132, a high-pass filter 24 extracts the colored, high frequency components 134 in a frequency range of 6.0–7.0 kHz. The high frequency components 112 in the frequency range of 6.0–7.0 kHz in the original speech sample 100 are also extracted by a high pass filter 12. The energy of the high frequency components 112 and 134 is used to determine a high-band signal scaling factor $g_{scaled}$ by a gain equalization block 14, according to:

$$g_{scaled}=sqrt\{(s_{hp}{}^{T}s_{hp})/(e_{hp}{}^{T}e_{hp})\} \quad (4)$$

where $s_{hp}$ is the 6.0–7.0 kHz band-pass filtered original speech signal 112, and $e_{hp}$ is the LPC synthesis (colored) and band-pass filtered random noise 134. The scaling factor $g_{scaled}$, as denoted by reference numeral 114 can be quantized by a gain quantization module 18 and transmitted within the encoded bit stream so that the receiving end can use the scaling factor to scale the random noise for the reconstruction of the speech signal.

In current GSM speech codecs, the radio transmission during non-speech periods is suspended by a Discontinuous Transmission (DTX) function. The DTX helps to reduce interference between different cells and to increase capacity of the communication system. The DTX function relies on a Voice Activity Detection (VAD) algorithm to determine whether the input signal represents speech or noise, preventing the transmitter from being turned off during the active speech periods. Furthermore, when the transmitter is turned off during the non-active speech periods, a minimum amount of background noise called "comfort noise" (CN) is provided by the receiver in order to eliminates the impression that the connection is dead. The VAD algorithm is designed such that a certain period of time, known as the hangover or holdover time, is allowed after a non-active speech period is detected.

Accordingly to the present invention, the scaling factor $g_{scaled}$ during active speech can be estimated in accordance with Equation 4. However, after the transition from active speech to non-active speech, this gain parameter cannot be transmitted within the comfort noise bit stream because of the bit rate limitation and the transmitting system. Thus, in the non-active speech, the scaling factor is determined in the receiving end without using the original speech signal, as carried out in the prior-art wideband codec. Thus, gain is implicitly estimated from the base layer signal during non-active speech. In contrast, explicit gain quantization is used during speech period based on the signal in the high frequency enhancement layers. During the transition from active speech to non-active speech, the switching between the different scaling factors may cause audible transients in the synthesized signal. In order to reduce these audible transients, it is possible to used a gain adaptation module 16 to change the scaling factor. According to the present invention, the adaptation of starts when the hangover period of the voice activity determination (VAD) algorithm begins. For that purpose, a signal 190 representing a VAD decision is provided to the gain adaption module 16. Furthermore, the hangover period of discontinuous transmission (DTX) is also used for the gain adaptation. After the hangover period of the DTX, the scaling factor determined without the original speech signal can be used. The overall gain adaptation to adjust the scaling factor can be carried out according to the following equation:

$$g_{total}=\alpha g_{scaled}+(1.0-\alpha)f_{est} \quad (5)$$

where $f_{est}$ is determined by Equation 3 and denoted by reference numeral 115, and $\alpha$ is an adaptation parameter, given by:

$$\alpha=(\text{DTX hangover count})/7 \quad (6)$$

Thus, during active speech, $\alpha$ is equal to 1.0 because the DTX hangover count is equal to 7. During a transient from active to non-active speech, the DTX hangover count drops from 7 to 0. Thus, during the transient, $0<\alpha<1.0$. During non-active speech or after receiving the first comfort noise parameters, $\alpha=0$.

In that respect, the enhancement layer encoding, driven by the voice activity detection and the source coding bit rate, is scalable depending on the different periods of input signal. During active speech, gain quantization is explicitly determined from the enhancement layer, which includes random noise gain parameter determination and adaptation. During the transient period, the explicitly determined gain is adapted towards the implicitly estimated value. During non-active speech, gain is implicitly estimated from the base layer signal. Thus, high frequency enhancement layer parameters are not transmitted to the receiving end during non-active speech.

The benefit of gain adaptation is the smoother transient of the high frequency component scaling from active to non-active speech processing. The adapted scaling gain $g_{total}$, as determined by the gain adaptation module 16 and denoted by reference numeral 116, is quantized by the gain quantization module 18 as a set of gain parameters 118. This set of gain parameters 118 can be incorporated into the encoded bit stream, to be transmitted to a receiving end for decoding. It should be noted that the gain parameters 118 can be stored as a look-up table so that they can be accessed by an gain index (not shown).

With the adapted scaling gain $g_{total}$, the high frequency random noise in the decoding process can be scaled in order to reduce the transients in the synthesized signal during the transition from active speech to non-active speech. Finally, the synthesized high frequency components are added to the up-sampled and interpolated signal received from the A-b-S loop in the encoder. The post processing with energy scaling is carried out independently in each 5 ms sub frame. With 4-bit codebooks being used to quantize the high frequency random component gain, the overall bit rate is 0.8 kbit/s.

The gain adaptation between the explicitly determined gain (from the high frequency enhancement layers) and the implicitly estimated gain (from the base layer, or lower band, signal only) can be carried out in the encoder before the gain quantization, as shown in FIG. 3. In that case, the gain parameters to be encoded and transmitted to the receiving end is $g_{total}$, according to Equation 5. Alternatively, gain adaptation can be carried out only in the decoder during the DTX hangover period after the VAD flag indicating the beginning of non-speech signal. In that case, the quantization of the gain parameters is carried out in the encoder and the gain adaptation is carried in the decoder, and the gain parameters transmitted to the receiving end can simply be $g_{scaled}$, according to Equation 4. The estimated gain $f_{est}$ can be determined in the decoder using the synthesized speech signal. It is also possible that gain adaptation is carried out in the decoder at the beginning of the comfort noise period before the first silence description (SID first) is received by the decoder. As with the previous case, $g_{scaled}$ is quantized in the encoder and transmitted within the encoded bit stream.

Figure 4:
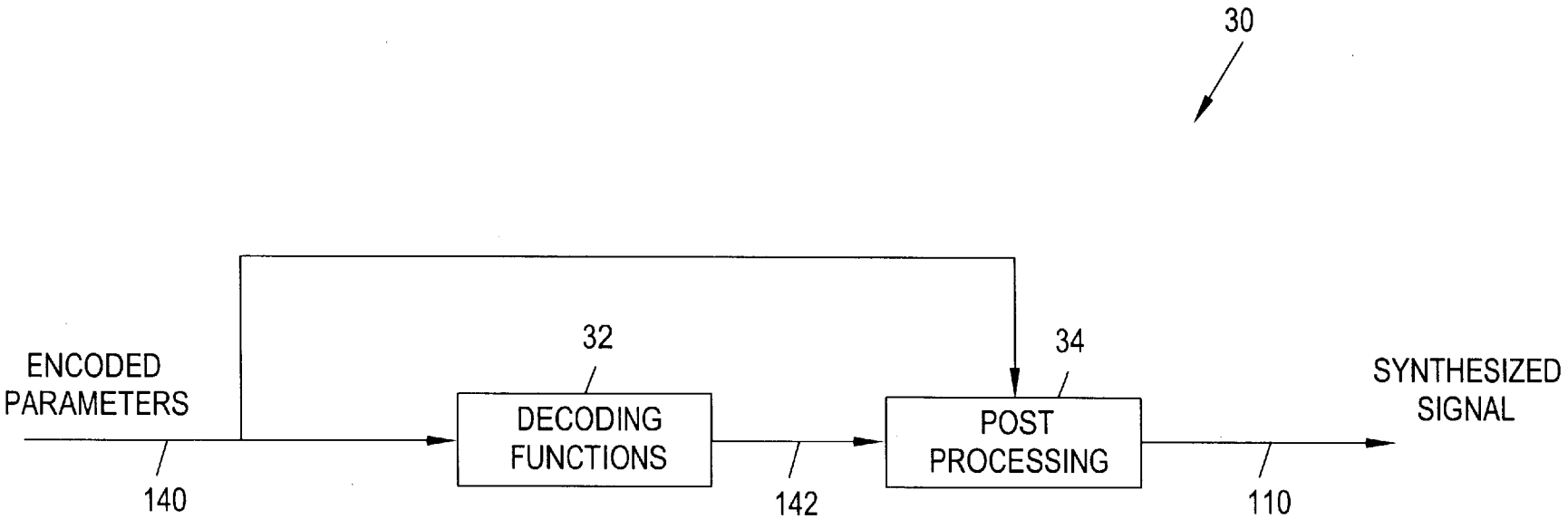
FIG. 4 is a block diagram illustrating the structure of the wideband speech decoder of the present invention.

A diagrammatic representation of the decoder 30 of the present invention is shown in FIG. 4. As shown, the decoder 30 is used to synthesize a speech signal 110 from the encoded parameters 140, which includes the LPC, pitch and excitation parameters 104 and the gain parameters 118 (see FIG. 3). From the encoded parameters 140, a decoding module 32 provides a set of dequantized LPC parameters 142. From the received LPC, pitch and excitation parameters 142 of the lower band components of the speech signal, the post processing module 34 produces a synthesized lower band speech signal, as in a prior art decoder. From a locally generated random noise, the post processing module 34 produces the synthesized high-frequency components, based on the gain parameters which includes the input signal characteristics of the high frequency components in speech.

Figure 5:
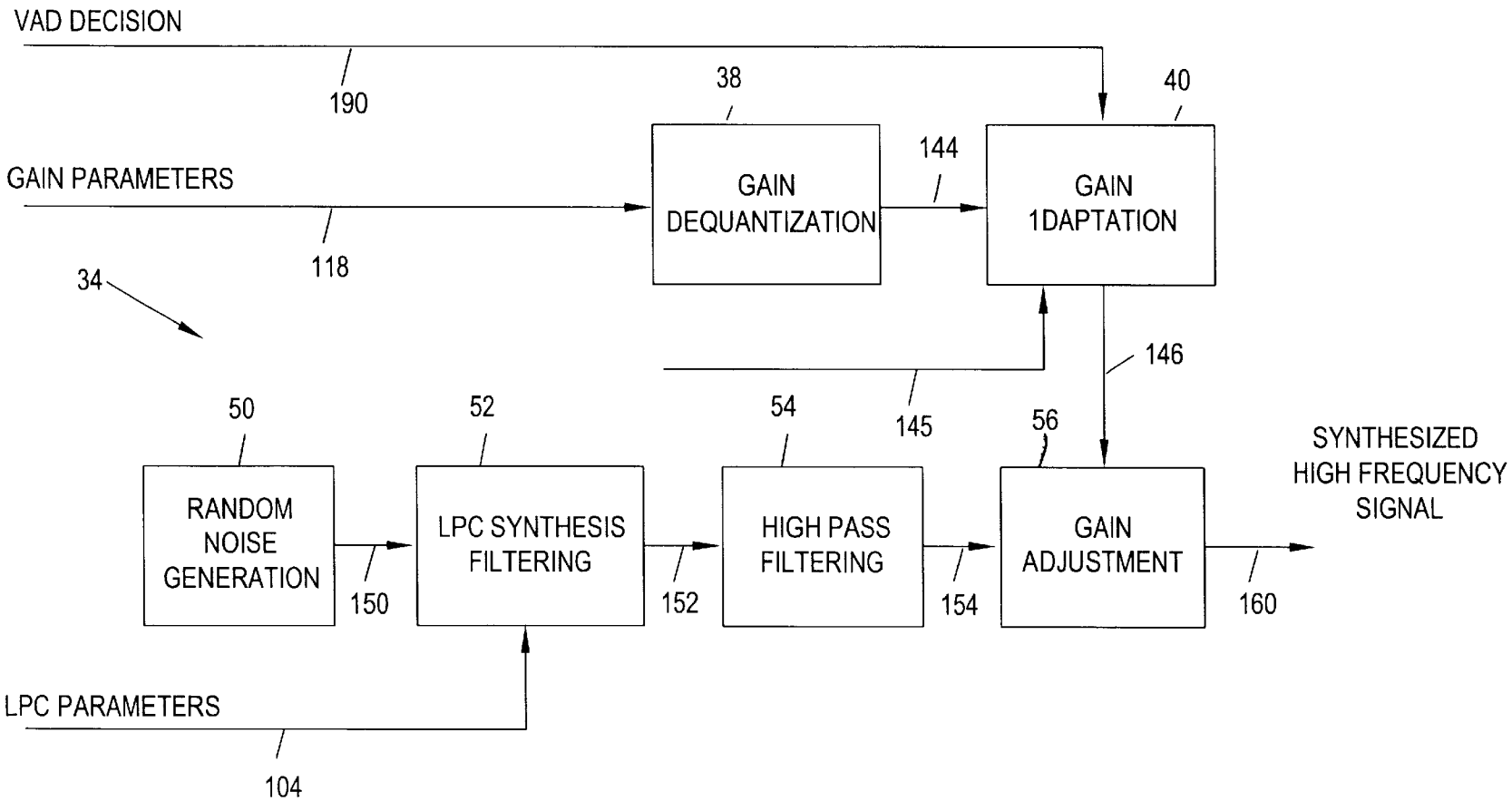
FIG. 5 is a block diagram illustrating the post-processing functionality of the wideband speech decoder.

A generalized, post-processing structure of the decoder 30 is shown in FIG. 5. As shown in FIG. 5, the gain parameters 118 are dequantized by a gain dequantization block 38. If gain adaptation is already carried out in the encoder, as shown in FIG. 3, then the relevant gain adaptation functionality in the decoder is to switch the dequantized gain 144 ($g_{total}$, with $\alpha$=1.0 and $\alpha$=0.5) to the estimated scaling gain $f_{est}$ ($\alpha$=0) at the beginning of the comfort noise period, without the need of the VAD decision signal 190. However, if gain adaptation is carried out only in the decoder during the DTX hangover period after the VAD flag provided in the signal 190 indicating the beginning of non-speech signal, then the gain adaptation block 40 determines the scaling factor $g_{total}$ according to Equation 5. Thus, in the beginning of the discontinuous transmission, the gain adaptation block 40 smooths out the transient using the estimated scaling gain $f_{est}$, as denoted by reference numeral 145, when it does not receive the gain parameters 118. Accordingly, the scaling factor 146, as provided by the gain adaptation module 40 is determined according to Equation 5.

The coloring and high-pass filtering of the random noise component in the post processing unit 34, as shown in FIG. 4, is similar to the post processing of the encoder 10, as shown in FIG. 3. As shown, a random noise generator 50 is used to provide an artificial signal 150, which is colored by an LPC synthesis filter 52 based on the received LPC parameters 104. The colored artificial signal 152 is filtered by a high-pass filter 54. However, the purpose of providing the colored, high-pass filtered random noise 134 in the encoder 10 (FIG. 3) is to produce $e_{hp}$ (Equation 4). In the post processing module 34, the colored, high-pass filtered artificial signal 154 is used to produce the synthesized high frequency signal 160 after being scaled by a gain adjustment module 56 base on the scaling factor 146 provided by the gain adaptation module 40. Finally, the output 160 of the high frequency enhancement layer is added to the 16 kHz synthesized signal received from the base decoder (not shown). The 16 kHz synthesized signal is well known in the art.

It should be noted that the synthesized signal from the decoder is available for spectral tilt estimation. The decoder post-processing unit may be used to estimate the parameter $f_{est}$ using Equations 2 and 3. In the case when the decoder or the transmission channel ignores the high-band gain parameters for various reasons, such as channel band-width limitations, and the high band gain is not received by the decoder, it is possible to scale the colored, high-pass filtered random noise for providing the high frequency components of the synthesized speech.

In summary, the post-processing step for carrying out the high frequency enhancement layer coding in a wideband speech codec can be performed in the encoder or the decoder.

When this post-processing step is performed in the encoder, a high band signal scaling factor $g_{scaled}$ is obtained from the high frequency components in the frequency range of 6.0–7.0 kHz of the original speech sample and the LPC-colored and band-pass filtered random noise. Furthermore, an estimated gain factor $f_{est}$ is obtained from the spectral tilt of the lower band synthesized signal in the encoder. A VAD decision signal is used to indicate whether the input signal is in an active speech period or in a non-active speech period. The overall scaling factor $g_{total}$ for the different speech periods is computed from the scaling factor $g_{scaled}$ and the estimated gain factor $f_{est}$. The scalable high-band signal scaling factors are quantized and transmitted within the encoded bit stream. In the receiving end, the overall scaling factor $g_{total}$ is extracted from the received encoded bit stream (encoded parameters). This overall scaling factor is used to scale the colored and high-pass filtered random noise generated in the decoder.

When the post-processing step is performed in the decoder, the estimated gain factor $f_{est}$ can be obtained from the lower-band synthesized speech in the decoder. This estimated gain factor can be used to scale the colored and high-pass filtered random noise in the decoder during active speech.

Figure 6:
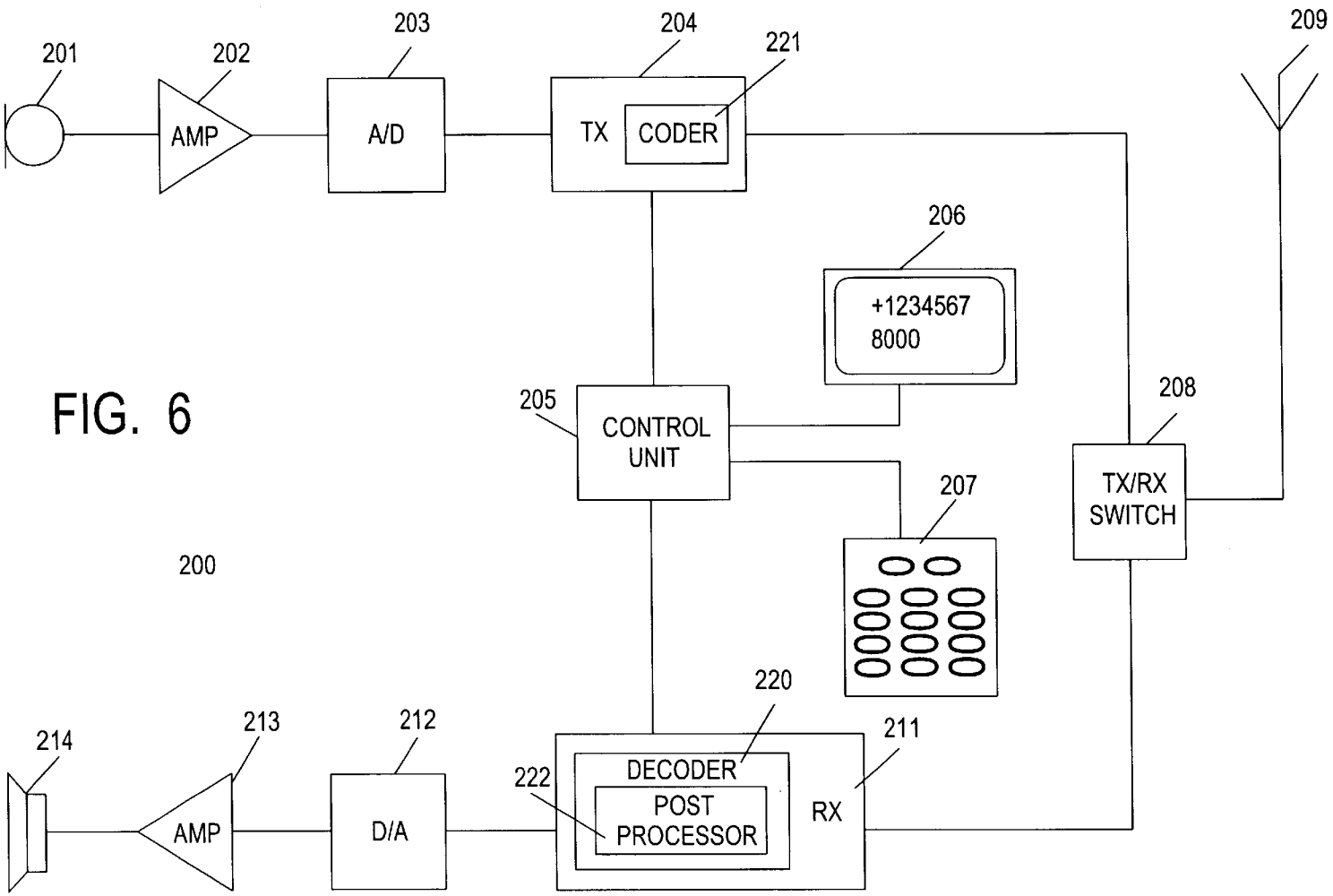
FIG. 6 is a block diagram illustrating a mobile station, according to the present invention.

FIG. 6 shows a block diagram of a mobile station 200 according to one exemplary embodiment of the invention. The mobile station comprises parts typical of the device, such as a microphone 201, keypad 207, display 206, earphone 214, transmit/receive switch 208, antenna 209 and control unit 205. In addition, the figure shows transmit and receive blocks 204, 211 typical of a mobile station. The transmission block 204 comprises a coder 221 for coding the speech signal. The coder 221 includes the post-processing functionality of the encoder 10, as shown in FIG. 3. The transmission block 204 also comprises operations required for channel coding, deciphering and modulation as well as RF functions, which have not been drawn in FIG. 5 for clarity. The receive block 211 also comprises a decoding block 220 according to the invention. Decoding block 220 includes a post-processing unit 222 like the decoder 34 shown in FIG. 5. The signal coming from the microphone 201, amplified at the amplification stage 202 and digitized in the A/D converter, is taken to the transmit block 204, typically to the speech coding device comprised by the transmit block. The transmission, signal processed, modulated and amplified by the transmit block, is taken via the transmit/receive switch 208 to the antenna 209. The signal to be received is taken from the antenna via the transmit/receive switch 208 to the receiver block 211, which demodulates the received signal and decodes the deciphering and the channel coding. The resulting speech signal is taken via the D/A converter 212 to an amplifier 213 and further to an earphone 214. The control unit 205 controls the operation of the mobile station 200, reads the control commands given by the user from the keypad 207 and gives messages to the user by means of the display 206.

Figure 7:
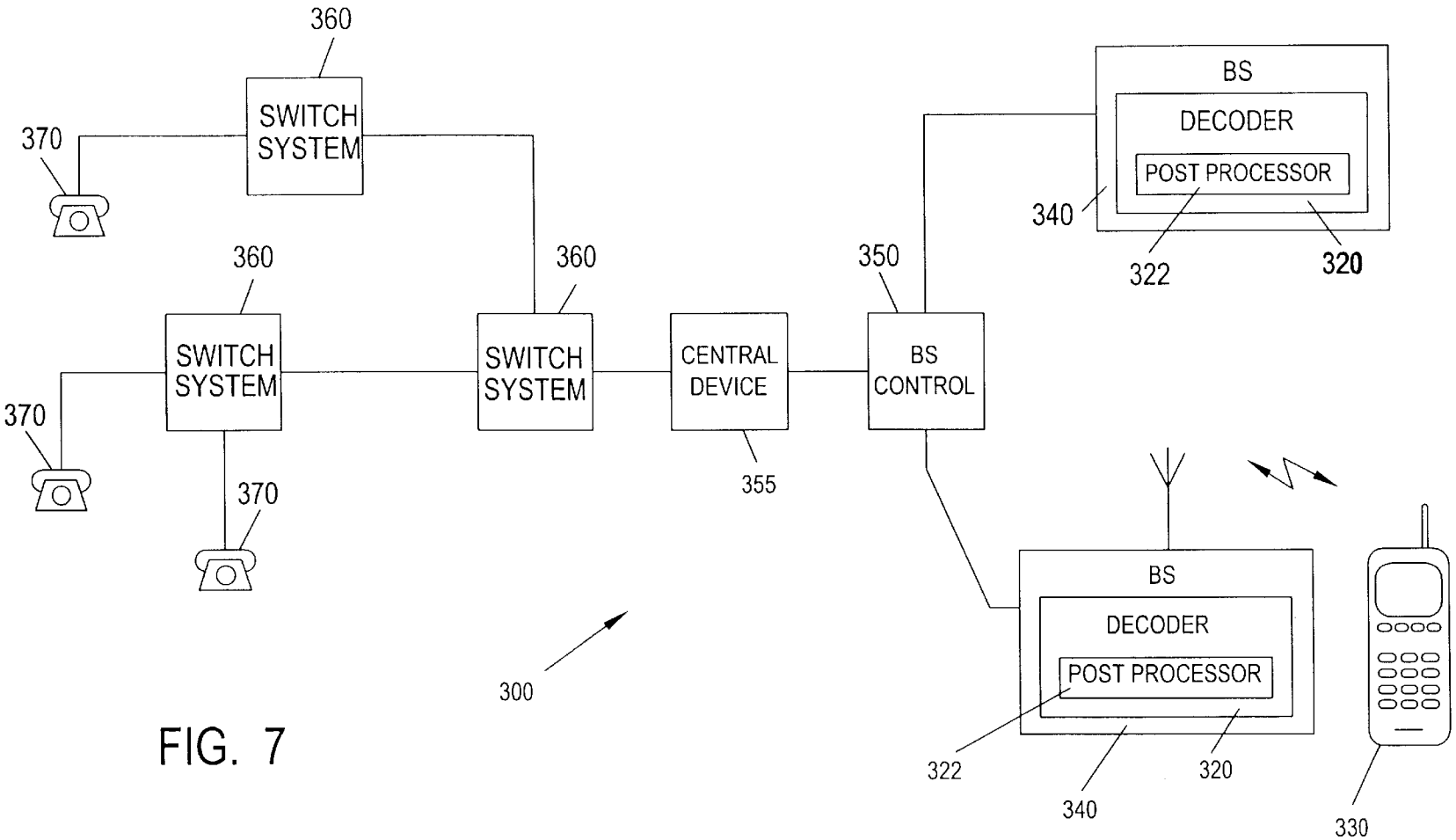
FIG. 7 is a block diagram illustrating a telecommunication network, according to the present invention.

The post processing functionality of the encoder 10, as shown in FIG. 3, and the decoder 34, as shown in FIG. 5, according to the invention, can also be used in a telecommunication network 300, such as an ordinary telephone network or a mobile station network, such as the GSM network. FIG. 7 shows an example of a block diagram of such a telecommunication network. For example, the telecommunication network 300 can comprise telephone exchanges or corresponding switching systems 360, to which ordinary telephones 370, base stations 340, base station controllers 350 and other central devices 355 of telecommunication networks are coupled. Mobile stations 330 can establish connection to the telecommunication network via the base stations 340. A decoding block 320, which includes a post-processing unit 322 similar to that shown in FIG. 5, can be particularly advantageously placed in the base station 340, for example. However, the decoding block 320 can also be placed in the base station controller 350 or other central or switching device 355, for example. If the mobile station system uses separate transcoders, e.g., between the base stations and the base station controllers, for transforming the coded signal taken over the radio channel into a typical 64 kbit/s signal transferred in a telecommunication system and vice versa, the decoding block 320 can also be placed in such a transcoder. In general the decoding block 320, including the post processing unit 322, can be placed in any element of the telecommunication network 300, which transforms the coded data stream into an uncoded data stream. The decoding block 320 decodes and filters the coded speech signal coming from the mobile station 330, whereafter the speech signal can be transferred in the usual manner as uncompressed forward in the telecommunication network 300.

In order to provide the higher frequency components of the synthesized speech, the artificial signal or random noise is filtered in a frequency range of 6.0–7.0 kHz. However, the filtered frequency range can be different depending on the sample rate of the codec, for example.

Although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A method of speech coding for encoding and decoding an input signal having active speech periods and non-active speech periods, and for providing a synthesized speech signal having higher frequency components and lower frequency components, wherein the input signal is divided into a higher frequency band and lower frequency band in encoding and speech synthesizing processes, and wherein speech related parameters characteristic of the lower frequency band are used to process an artificial signal for providing the higher frequency components of the synthesized speech, said method comprising the steps of:

scaling the processed artificial signal with a first scaling factor during the active speech periods, and scaling the processed artificial signal with a second scaling factor during the non-active speech periods, wherein the first scaling factor is characteristic of the higher frequency band of the input signal, and the second scaling factor is characteristic of the lower frequency band of the input signal.

2. The method of claim 1, wherein the processed artificial signal is high-pass filtered for providing a filtered signal in a frequency range characteristic of the higher frequency components of the synthesized speech.

3. The method of claim 2, wherein the frequency range is in the 6.0–7.0 kHz range.

4. The method of claim 1, wherein the input signal is high-pass filtered for providing a filtered signal in a frequency range characteristic of the higher frequency components of the synthesized speech, and wherein the first scaling factor is estimated from the filtered signal.

5. The method of claim 4, wherein the non-active speech periods include speech hangover periods and comfort noise periods, wherein the second scaling factor for scaling the processed artificial signal in the speech hangover periods is estimated from the filtered signal.

6. The method of claim 5, wherein the lower frequency components of the synthesized speech are reconstructed from the encoded lower frequency band of the input signal, and wherein the second scaling factor for scaling the processed artificial signal in the speech hangover periods is also estimated from the lower frequency components of the synthesized speech.

7. The method of claim 6, wherein the second scaling factor for scaling the processed artificial signal in the comfort noise periods is estimated from the lower frequency components of the synthesized speech.

8. The method of claim 7, wherein the second scaling factor for scaling the processed artificial signal in the comfort noise periods is indicative of a spectral tilt factor determined from the lower frequency components of the synthesized speech.

9. The method of claim 6, further comprising transmitted an encoded bit stream to a receiving end for decoding, wherein the encoded bit stream includes data indicative of the first scaling factor.

10. The method of claim 9, wherein the encoded bit stream includes data indicative of the second scaling factor for scaling the processed artificial signal in the speech hangover periods.

11. The method of claim 9, wherein the second scaling factor for scaling the processed artificial signal is provided in the receiving end.

12. The method of claim 6, wherein the second scaling factor is indicative of a spectral tilt factor determined from the lower frequency components of the synthesized speech.

13. The method of claim 4, wherein the first scaling factor is further estimated from the processed artificial signal.

14. The method of claim 1, further comprising the step of providing voice activity information based on the input signal for monitoring the active-speech periods and the non-active speech periods.

15. The method of claim 1, wherein the speech related parameters include linear predictive coding coefficients characteristic of the lower frequency band of the input signal.

16. A speech signal transmitter and receiver system for encoding and decoding an input signal having active speech periods and non-active speech periods and for providing a synthesized speech signal having higher frequency components and lower frequency components, wherein the input signal is divided into a higher frequency band and a lower frequency band in the encoding and speech synthesizing processes, wherein speech related parameters characteristic of the lower frequency band of the input signal are used to process an artificial signal in the receiver for providing the higher frequency components of the synthesized speech, said system comprising:

a decoder in the receiver for receiving an encoded bit stream from the transmitter, wherein the encoded bit stream contains the speech related parameters;

a first means in the transmitter, responsive to the input signal, for providing a first scaling factor for scaling the processed artificial signal during the active periods, and a second means in the receiver, responsive to the encoded bit stream, for providing a second scaling factor for scaling the processed artificial signal during the non-active periods, wherein the first scaling factor is characteristic of the higher frequency band of the input signal and the second scaling factor is characteristic of the lower frequency band of the input signal.

17. The system of claim 16, wherein the first means comprises a filtering means for high pass filtering the input signal and providing a filtered input signal having a frequency range corresponding to the higher frequency components of the synthesized speech, and wherein the first scaling factor is estimated from the filtered input signal.

18. The system of claim 17, wherein the frequency range is in the 6.0–7.0 kHz range.

19. The system of claim 17, further comprising a third means in the transmitter for providing a high-pass filtered random noise in the frequency range corresponding to the higher frequency components of the synthesized signal and for modifying the first scaling factor based on the high-pass filtered random noise.

20. The system of claim 19, further comprising means, responsive to the first scaling factor, for providing an encoded first scaling factor and for included data indicative of the encoded first scaling factor into the encoded bit stream for transmitting.

21. The system of claim 16, further comprising means, responsive to the input signal, for monitoring the active and non-active speech periods.

22. The system of claim 16, further comprising means, responsive to the first scaling factor, for providing an encoded first scaling factor and for included data indicative of the encoded first scaling factor into the encoded bit stream for transmitting.

23. An encoder for encoding an input signal having active speech periods and non-active speech periods and the input signal is divided into a higher frequency band and a lower frequency band, and for providing an encoded bit stream containing speech related parameters characteristic of the lower frequency band of the input signal so as to allow a decoder to use the speech related parameters to process an artificial signal for providing the high frequency components of the synthesized speech, and wherein a scaling factor based on the lower frequency band of the input signal is used to scale the processed artificial signal during the non-active speech periods, said encoder comprising:

means, responsive to the input signal, for high-pass filtering the input signal in a frequency range corresponding to the higher frequency components of the synthesized speech, and for providing a further scaling factor based on the high-pass filtered input signal; and means, responsive to the further scaling factor, for providing an encoded signal indicative of the first scaling factor into the encoded bit stream, so as to allow the decoder to receive the encoded signal and use the further scaling factor to scale the processed artificial signal during the active-speech periods.

24. A mobile station, which is arranged to transmit an encoded bit stream to a decoder for providing synthesized speech having higher frequency components and lower frequency components, wherein the encoded bit stream includes speech data indicative of an input signal having active speech periods and non-active periods, and the input signal is divided into a higher frequency band and lower frequency band, wherein the speech data includes speech related parameters characteristic of the lower frequency band of the input signal so as to allow the decoder to provide the lower frequency components of the synthesized speech based on the speech related parameters, and to color an artificial signal based on the speech related parameters and to scale the colored artificial signal with a scaling factor, based on the lower frequency components of the synthesized speech, for providing the high frequency components of the synthesized speech during the non-active speech periods, said mobile station comprising:

a filter, responsive to the input signal, for high-pass filtering the input signal in a frequency range corresponding to the higher frequency components of the synthesized speech, and for providing a further scaling factor based on the high-pass filtered input signal; and a quantization module, responsive to the scaling factor and the further scaling factor, for providing an encoded signal indicative of the further scaling factor in the encoded bit stream, so as to allow the decoder to scale the colored artificial signal during the active-speech period based on the further scaling factor.

25. An element of a telecommunication network, which is arranged to receive an encoded bit stream containing speech data indicative of an input signal from a mobile station for providing synthesized speech, having higher frequency components and lower frequency components, wherein the input signal having active speech periods and non-active periods, and the input signal are divided into a higher frequency band and lower frequency band, wherein the speech data includes speech related parameters characteristic of the lower frequency band of the input signal, said element comprising:

a first mechanism, responsive to the speech data, for providing the lower frequency components of the synthesized speech based on the speech related parameters, and for providing a first signal indicative of the lower frequency components of the synthesized speech;

a second mechanism, responsive to the speech data, for synthesis and high-pass filtering an artificial signal for providing a second signal indicative of the synthesis and high-pass filtered artificial signal;

a third mechanism, responsive to the first signal, for providing a first scaling factor based on the lower frequency components of the synthesized speech; and a forth mechanism, responsive to the encoded bit stream, for providing a second scaling factor based on gain parameters characteristic of the higher frequency band of the input signal, wherein the gain parameters are included in the encoded bit stream; and a fifth mechanism, responsive to the second signal, for scaling the synthesis and high-pass filtered artificial signal with the first and second scaling factors during non-active speech periods and active speech periods, respectively.

* * * * *

UNITED STATES PATENT AND TRADEMARK OFFICE

CERTIFICATE OF CORRECTION

PATENT NO. : 6,615,169 B1
DATED : September 2, 2003
INVENTOR(S) : Ojala et al.

It is certified that error appears in the above-identified patent and that said Letters Patent is hereby corrected as shown below:

Column 1,
Line 34, “and-” should be -- and --.

Column 3,
Line 65, “the,” should be -- the --.

Signed and Sealed this

Sixth Day of January, 2004

JAMES E. ROGAN
*Director of the United States Patent and Trademark Office*

UNITED STATES PATENT AND TRADEMARK OFFICE

CERTIFICATE OF CORRECTION

PATENT NO. : 6,615,169 B1
APPLICATION NO. : 09/691440
DATED : September 2, 2003
INVENTOR(S) : Pasi Ojala et al.

It is certified that error appears in the above-identified patent and that said Letters Patent is hereby corrected as shown below:

In the Claims

Column 13, Line 40, Claim 23, replace “first scaling factor” with --further scaling factor--

Signed and Sealed this
Eleventh Day of August, 2015

Michelle K. Lee

Michelle K. Lee
*Director of the United States Patent and Trademark Office*